US005253423A

United States Patent [19]

Sullivan, Jr. et al.

[11] Patent Number: 5,253,423

[45] Date of Patent: Oct. 19, 1993

[54] CROSS HAIR PENDULUM BOW SIGHT

[75] Inventors: James H. Sullivan, Jr., Ware Shoals; Harvey L. Loudermilk, Waterloo, both of S.C.

[73] Assignee: James Sullivan, Jr., Ware Shoals, S.C.

[21] Appl. No.: 958,080

[22] Filed: Oct. 8, 1992

[51] Int. Cl.[5] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,559,927 | 7/1951 | Beloungy | 33/265 |
| 4,120,096 | 10/1978 | Keller | 33/265 |
| 4,563,821 | 1/1986 | Saunders | 33/265 |
| 4,711,036 | 12/1987 | Morris | 33/265 |
| 4,974,328 | 12/1990 | Lowry | 33/265 |
| 5,121,547 | 6/1992 | Littlejohn | 33/265 |
| 5,131,153 | 7/1992 | Seales | 33/265 |

*Primary Examiner*—William A. Cuchlinski, Jr.
*Assistant Examiner*—C. W. Fulton
*Attorney, Agent, or Firm*—Cort Flint

[57] ABSTRACT

A sighting arrangement for an archer's bow having a handle, a pair of limbs, an arrow seat, a ballistic string system including cams, mounted at an end of each limb and a peep sight incorporated in the string system. The arrangement includes a sight housing having spaced parallel outer horizontal and vertical sides, one of which includes means mounting the sight housing with the handle in position so that the vertical sides are substantially coplanar with a longitudinal axis of the handle. A sighting element is pivotally mounted by bearings provided in side walls of the housing so that the sighting element is pivotable relative to the handle so that it will always extend along true vertical regardless of the vertical angle of the bow when in shooting position. A sighting opening is formed also in the sighting element which includes traversing vertical and horizontal cross hairs. The sighting element includes an annular reference element which parallels the sighting opening to form a frame about a major portion of the periphery of the openings. A sighting frame is formed joining opposed ends of the arcuate frame to completely surround the opening. The peep sight opening and annular reference element are of a size that when the bow is in shooting position with the string system drawn taught, only the outer edges of said annular reference element are visible through the peep sight when the bow is properly aimed.

18 Claims, 2 Drawing Sheets

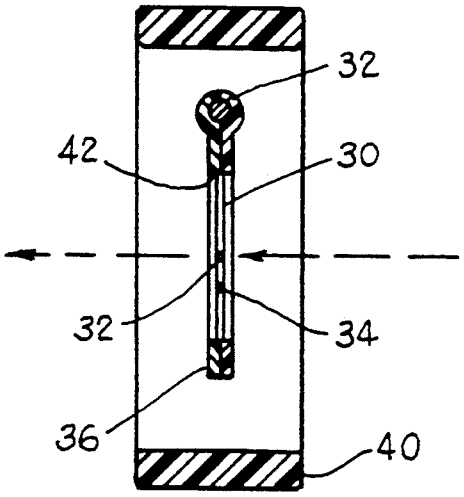
Fig. 3-A.
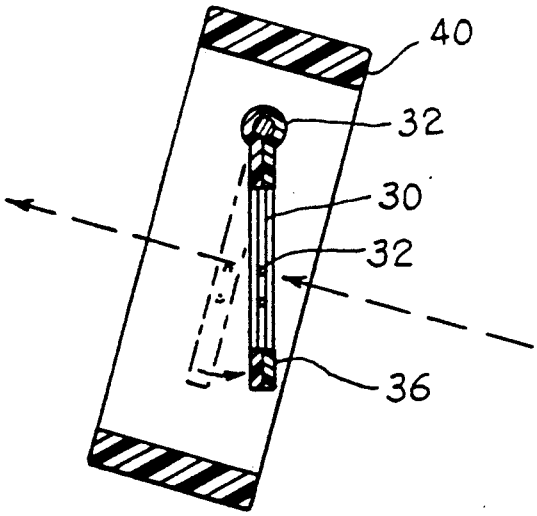
Fig. 3-B.
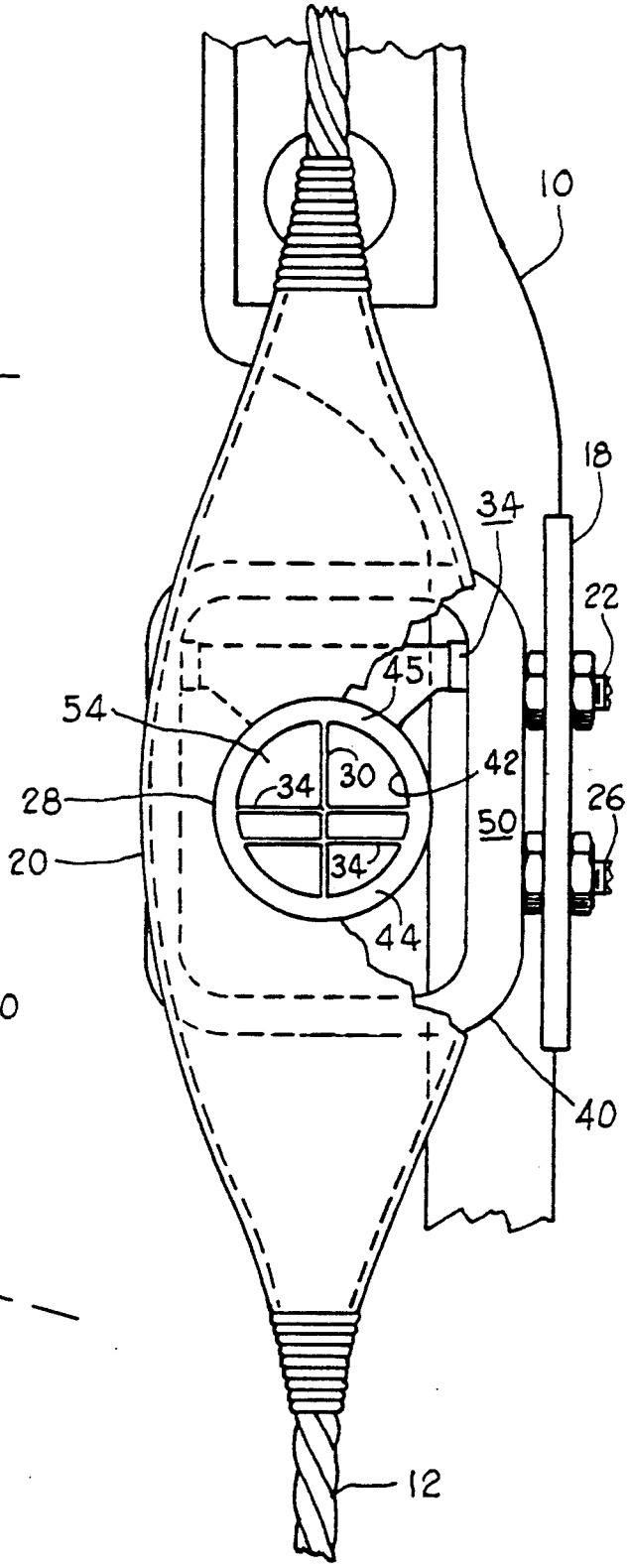
Fig. 4.

CROSS HAIR PENDULUM BOW SIGHT

BACKGROUND OF THE INVENTION

This invention is directed to a sighting system and the method of calibrating a sighting system for a compound bow with an archer.

One of the problems with past sighting arrangements is that they are designed for use with the archer and target being substantially on the same plane. These sights are calibrated or zeroed in to shoot targets at prescribed distances. However, much bow shooting is done with the archer being on an elevated plane above target or vice versa. When aiming downward or upward, the sight assumes the same angle as the bow and thus invalidates the calibrations or zeroing in for distance of the sighting arrangement.

Another problem with the usual type of sighting systems is that the sighting elements are not sized in relation to the size of the peep sight. The omission of such a correlation make the possibility for miss-sighting more probable because it does not allow for the ability to check and determine if in fact the target is properly sighted in.

U.S. Pat. Nos. 3,477,130; 4,120,096, and 4,974,328 show attempts to overcome at least certain of the above problems. The patents provide sights which may be calibrated at elevated angles relative to the target. The sight face is adjusted to the desired angle and locked into position. The sights do not allow for instantaneous variations in the angle of the shot and therefore their effectiveness is limited. They also do not address the ability to instantaneously check for sighting accuracy.

In order to overcome the variance in calibration problem, sights have been designed which allow for the sight to be maintained at true vertical. This is accomplished by pivotally mounting the sight to the bow. This arrangement allows the sight to pivot relative to the vertical angle of the bow and to always extend along true vertical. One such arrangement is sold by Browning Archery Products of Morgan, Utah. The sight is marketed as the Equalizer TM, model 0234012.

The Browning arrangement does not provide for correlation between its sighting elements and the peep sight size, nor does it utilize vertical and transverse cross hairs.

Other arrangements which deal with always maintaining the sight aligned with true vertical are shown in U.S. Pat. Nos. 4,535,544 and 5,121,547. In '544, a single sighting point 21 comprising a light emitting diode is aligned with a vertical cross hair. The point 21 is pivotally mounted while the cross hair is not. Point 21 adjusts relative to the cross hair as the bow is moved up and down. In '547 a telescopic scope is pivotally mounted to a frame and adjusts its position as the bow is moved relative to horizontal. The arrangement disclosed is very expensive as it includes a telescopic scope having a fiber optic sight pin and sighting indicia for distance variations. None of these references are concerned with the combination of a peep sight specifically selected to be used with a specific bow sight, nor do they recognize the desirability of means to instantaneously check for sighting accuracy.

It is an object of this invention to overcome the problems exhibited by the prior art as noted above.

Another object of the invention is to provide a sighting arrangement which includes a check system for determining the accuracy of the aim.

Another object of the invention is to provide a sighting arrangement in which the size of the bow sight is matched with the size of the peep sight.

Another object of the invention is to provide an inexpensive yet extremely accurate sighting arrangement.

Another object of the invention is to provide a sighting arrangement which adjusts with changes in position of the bow.

Another object of the invention is to provide a sighting arrangement which is customized for an individual archer.

SUMMARY OF THE INVENTION

A sighting arrangement for an archer's bow having a handle, a pair of limbs, an arrow seat, a sight support, a ballistic string system including cams, mounted at an end of each limb and a peep sight incorporated in the string system. The sighting arrangement includes a sight housing having spaced parallel outer horizontal and vertical sides with one of said vertical sides including means mounting the sight housing with the sight support. The vertical sides of the sight housing are substantially co-planar with a longitudinal axis of the handle. Each of the vertical sides includes a bearing formed in its inner edge.

A sighting member including a shaft, is pivotally mounted by the bearings in the sighting housing so that the sighting member is pivotable relative to the sight housing to always extend along true vertical regardless of the vertical angle of said bow when in shooting position.

A sighting opening is formed in a portion of the sighting member remote from the shaft. The edge of the sighting member adjacent the opening is accurate with its edge extending coplanar with the periphery of the sighting opening. A frame is formed between the edge of the opening and the edge of the periphery. The sighting opening includes traversing vertical and horizontal cross hairs arranged therein. The sighting opening is of a size so that when the bow is in shooting position with the string system drawn taught and an arrow engaged therewith, only the cross hairs and frame are visible through the peep sight when said bow is properly aimed. This is true regardless of the angle of the bow relative to true vertical.

The sighting opening is circular and has a diameter between 1.0 and 1.6 inches. An upper one of the horizontal cross hairs is arranged at the mid point of the sighting opening. This cross hair is the upper of at least two horizontal cross hairs which is calibrated for an optimum range.

A sighting system for individualized use with an archer and bow including a peep sight, having an opening of selected size, arranged in a bow string, and a sighting member having a sighting opening of a prescribed diameter which is partially enclosed by an accurate frame. The sighting opening includes vertical and horizontal cross hairs arranged at least at intermediate locations within the opening. A housing is secured to the bow and pivotally mounts the sighting member so that its longitudinal axis is capable of always being parallel with true vertical when the bow is in shooting position.

The system being such that when the bow is armed with an arrow, and the bow string is drawn to its shooting position, proper sighting through the peep sight reveals only the cross hairs and frame to their outer extremities regardless of the vertical bow position. The peep sight is between 70/1000 and 80/1000 inches in diameter, the exact selection being made in dependence upon the pull back distance and the position of the head of the archer. A major portion of the sighting member has an edge which is arcuate and the sighting opening is arranged substantially adjacent that edge.

The housing is slightly rectangular and consist of a pair of vertical side walls and a pair of horizontal side walls. The vertical side walls pivotally mount the sighting member substantially adjacent a second edge thereof which edge is opposite the first edge.

The housing is mounted to the bow handle for horizontal and vertical adjustment.

A method of custom sighting a bow for an archer comprising the steps of; providing a sighting member adjacent a bow which sighting member having the ability to maintain its longitudinal axis coplanar with true vertical when the bow is in shooting position; providing a sighting opening in the sighting member and providing the sighting opening with vertical and transverse cross hairs; providing a frame about a major portion of said sighting opening; providing a peep sight in the bow string; selecting the diameter of one of the peep sight and sighting opening, in dependence upon the length of draw back and the head position of the archer so that when the bow is armed with an arrow and the archer has drawn the bow string into shooting position, only the cross hairs and frame are seen through the peep sight. The diameter of the sighting opening may be selected to be between 1" and 1.6" and the diameter of the peep sight may be selected to be between 70/1000" and 80/1000".

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3A is a side sectional view of the sighting member taken along line 3—3 of FIG. 2.

FIG. 3B is a side sectional view of the sighting member similar to FIG. 3A but showing the relationship of the housing and the sighting element when the bow is elevated above parallel; and FIG. 4 is a sectional rear view showing the relationship of the peep sight and sighting member.

DESCRIPTION OF A PREFERRED EMBODIMENT

Figure 1:
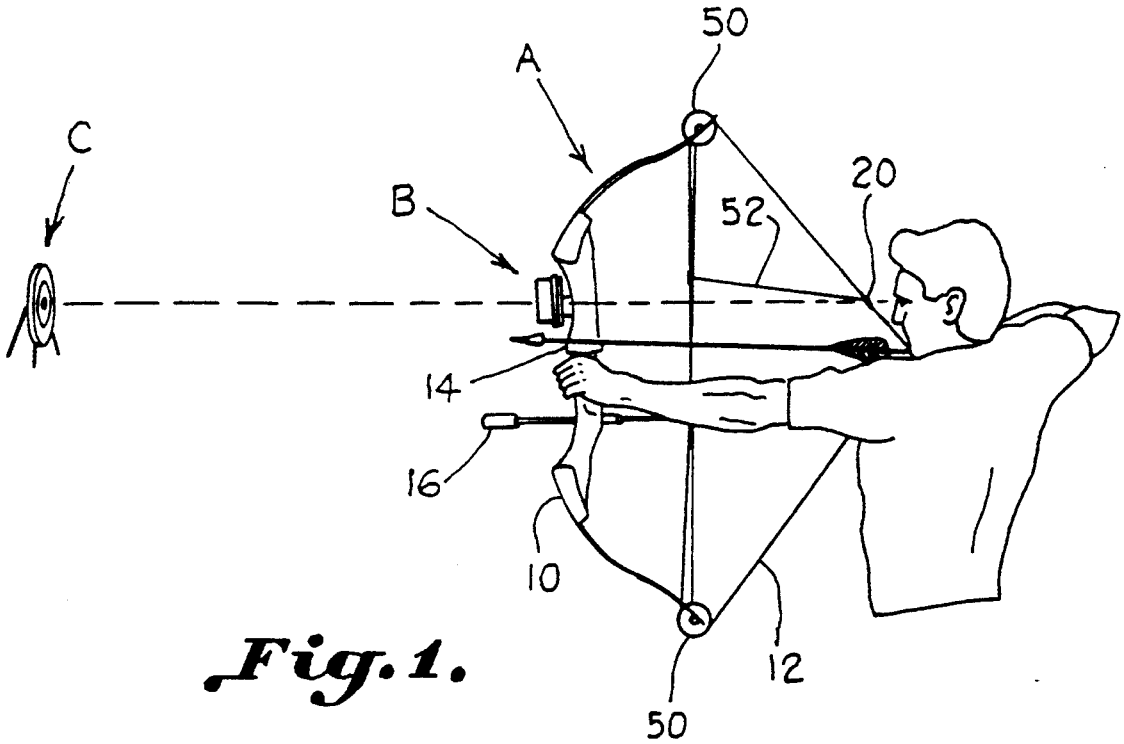
FIG. 1 is a perspective view showing the bow in shooting position, the archer, and the target.

Referring now in more detail to the drawings, FIG. 1 shows an archer holding bow A in the shooting position with the arrow resting in seat 14 and bow string 12 drawn to the ready position. The archer is shown sighting through peep sight 20 and sighting device B and sighting on target C.

The sighting arrangement of the invention is operative with any type of bow, however, it is preferred that it be used with a compound bow such as one of the MIRAGE TM series by Browning. The particular bow shown includes a handle or body portion 10 which mounts a flexible limb at each end. A cam 50 is rotatably secured to the opposite ends of the limbs. Bow string 12 is strung about cams 50 in the usual manner and includes a peep sight 20. The peep sight is aligned with sighting member B when the bow string is drawn to the shooting position in the usual manner by tether 52. Bow A includes a cable guard 16 which is commonly provided with bows having a ballistic string system and forms no part of the invention.

Peep sight 20 may be of any known construction such as the Zero Peep Sight TM manufactured by Fine Line Products of Puyallup, Wash., or the Tri-Select Peep TM manufactured by Browning Products. Both of these peep sights are capable of providing peep openings of different sizes. The Zero Peep Sight TM contains six adjustments each of 10/1000 inch and ranges between 40/1000 and 80/1000 inch. The Tri-Select Peep TM is provided with three sizes, 3/64 inch, 1/16 inch, and ⅛ inch. It will become clear further in the specification why an adjustable peep is necessary.

Figure 2:
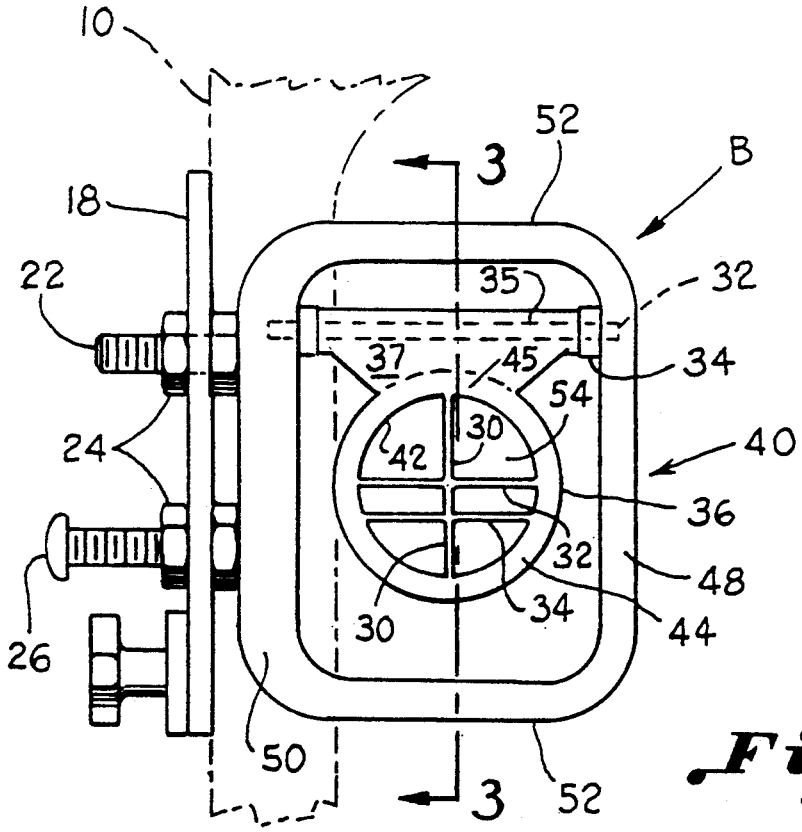
FIG. 2 is a front view of the sighting member shown in FIG. 1.

Turning now to FIGS. 2–4, sighting member B is shown in FIG. 2 from the front, i.e. the side away from the archer in FIG. 1. Sighting member B includes a substantially rectangular hollow frame 40 which consists of vertical side members 48, 50 which are approximately 3 inches long and a pair of horizontal top and bottom members 52 which are approximately 2.5 inches long. Vertical side member 50 contains the bow handle mounting means, such as bolts 22, lock nuts 24, adjusting screw 20, and reinforcing plate 18, which act to adjustably secure sighting device B to handle 10. These mounting means are common and form no part of the instant invention. Vertical side member 50 is shown as being substantially twice as thick as side members 48 and 52. This additional size is due to the fact that side 50 carries the mounting means and mounts to handle 10. This requires additional strength so that the sight member may be stable. Vertical sides 48, 50 have bearings 32 formed in their opposing inner faces near their upper ends.

A sighting element 36 which consists of a substantially planar elongated piece having a rod 35 arranged across its upper end. Opposite ends of rod 35 are mounted in opposed bearing members 32 and the sighting element is arranged in a proper position relative to side members 48, 50 by spacers 34. A neck portion 37 connects the upper portion of the sighting element 36 with the sighting frame 44. A sighting opening 54 is formed in sighting frame 44 which comprises substantially the lower two thirds of the sighting element. The opening which is approximately 1.2 inches in diameter is formed with a vertical cross hair 30 and a horizontal cross hair 32. These cross hairs cross each other at the exact center or axis of opening 54. Cross hairs 30, 32 are used for sighting in at the optimum range of up to thirty yards. An additional horizontal cross hair 34 is provided below cross hair 32 and provides added range of between thirty and forty yards. The cross hairs terminate at and are secured to the inner face 42 of opening 54.

The frame 44 of sighting element 36 is formed about opening 54. Frame 44 extends from neck 37 in an arcuate path which parallels inner surface 42 around opening 54. The front surface of neck 37 adjacent opening 54 is designed to form the appearance of a continuation of frame 44 by being slightly raised or depressed or marked in some other manner such as paint. The continuation is indicated at 45.

Frame 44 including continuation 45 are approximately 4/10 inch wide and completely encircle the sighting opening. Frame 44 including continuation 45 and are herein after referred to as the sighting frame.

With sighting member B in position on bow A, sighting element 36 is pivotally mounted in housing 40 which allows it will always extend parallel with true vertical regardless of the angle of the bow relative horizontal. By providing that the sighting element adjust its position relative to the angle of the bow, a true sighting picture may be maintained in an actual hunting situation.

The sighting arrangement of the invention provides precise and accurate sighting of a target. The arrangement provides an additional feature however and that is it provides a sighting check which is performed instantaneous with sighting. In order that the arrangement may provide a sighting check and also provide accurate sighting it must be customized for each individual archer. Due to individual variations in arm length and strength, the bow string is drawn back to varying positions between archers. Also, due to preference and physical make up, each archer will position his head differently when sighting through the peep sight. These two main variances would cause variations of exactly what is seen through the peep sight if only one size sight is employed.

In accordance with the invention, the size of the peep sight is selected so that when the archer is in the position shown in FIG. 1, his view through pepe sight 20 to target C allows him to see through opening 54 and sighting frame 44, 45. Proper sighting consist of aligning the cross point of cross hairs 30, 32 on the target. The instantaneous check consists of ensuring that sighting frame 44, 45 is seen evenly silhouetting opening 54. A circular reference or surface face is viewed flush with the interior surface diameter of peep sight 20. The circular reference face may be the outside or inside surface 28, 42, of frame 44 or a circular reference face having a width painted around inside surface 42. When using inside surface 42, the interengaging points of the surface and cross hairs is made flush with the interior diameter of the peep sight opening. Should the line of sight extend beyond any portion of sighting frame 44, 45 there is an error in sighting which can easily and quickly be corrected with a slight adjustment.

By being able to make this instantaneous check, the accuracy of the archer is greatly enhanced.

While a preferred embodiment of the invention has been described using specific terms, such description is for illustrative purposes only, and it is to be understood that changes and variations may be made without departing from the spirit or scope of the following claims.

What is claimed is:

1. A sighting arrangement for an archer's bow having a handle, a pair of limbs, an arrow seat, a ballistic string system including cams mounted at an end of each limb and a peep sight incorporated in the string system, said sighting arrangement including;

a sight housing having spaced parallel outer horizontal and vertical sides, one of said vertical sides including means mounting said sight housing with said handle in position so that said vertical sides are substantially coplanar with a longitudinal axis of said handle;

each of said vertical sides includes a bearing formed in its inner edge;

a sighting member having a shaft formed integral therewith and arranged substantially along its upper edge, opposite ends of said shaft are pivotally mounted by said bearings so that said sighting member is pivotable relative to said sight housing and capable of always extending along true vertical regardless of the vertical angle of said bow when in shooting position;

an annular reference surface formed around said sighting member remote from said shaft, said annular reference surface having traversing vertical and horizontal cross hairs arranged therein;

said annular reference surface being of a size that when said bow is in shooting position with said string system drawn taught and an arrow engaged therewith, only said cross hairs and said annular reference surface are visible through said peep sight when said bow is properly aimed regardless of the angle of said bow relative to true vertical.

2. The sighting arrangement of claim 1 wherein said annular reference surface is circular and has a diameter of between 1.0 and 1.6 inches.

3. The sighting arrangement of claim 1 wherein an upper one of said horizontal cross hairs is arranged at the midpoint of said annular reference surface.

4. The sighting arrangement of claim 3 wherein there are at least two horizontal cross hairs, said upper cross hair being calibrated for an optimum range and at least another of said cross hairs spaced below said upper cross hair;

said another of said cross hairs being calibrated for greater distances.

5. The sighting arrangement of claim 1 wherein said sighting frame is between 0.4 and 0.5 inches in width.

6. A sighting system for individualized use with an archer and bow, said system comprising:

a peep sight, having an opening of selected size, arranged on a bow string;

a sighting member having a longitudinal axis and an arcuate end portion around which is formed an annular reference frame of prescribed diameter;

vertical and horizontal cross hairs arranged at least at intermediate locations within said annular reference frame;

a housing secured to said bow, said housing pivotally mounting said sighting member so that its longitudinal axis is capable of always being parallel with true vertical regardless of the vertical position of said bow when in shooting position;

the system being such that when said bow is armed with an arrow and said bow string is to its drawn shooting position, proper sighting through said peep sight reveals only said cross hairs and said annular reference frame regardless of said vertical bow position.

7. The sighting system of claim 6 wherein said peep sight is between 70/1000 and 80/1000 inches in diameter, the selection being made in dependence upon the pull back distance of said archer.

8. The sighting system of claim 6 wherein said frame comprises a majority portion of said sighting member.

9. The sighting system of claim 8 wherein said housing is substantially rectangular and consist of a pair of vertical side walls and a pair of horizontal side walls.

10. The sighting system of claim 9 wherein said vertical side walls pivotally mount said sighting member substantially adjacent a second edge thereof which is opposite said first edge.

11. The sighting system of claim 6 wherein means are provided to mount said housing to said bow for horizontal and vertical adjustment.

12. A sighting system for individualized use with an archer and bow, said bow being of the type having a bow string with a peep sight carried on said bow string having an opening of selected size, wherein said sighting system comprises:

a frame for attachment to a handle portion of said bow;

a sighting member pivotally carried by said frame;

vertical and horizontal cross hairs arranged within said sighting member;

said sighting member comprising an annular internal reference surface defining an annular sighting element;

said annular sighting element and peep sight being calibrated in their diameters so that when said bow string is drawn to a shooting position, proper sighting through said peep sight reveals only said annular reference surface of said frame regardless of vertical orientation of said bow.

13. The system of claim 12 wherein said frame comprises a rectangular housing consisting of a pair of vertical sidewalls and a pair of horizontal sidewalls.

14. The system of claim 13 wherein one of said vertical sidewalls has a cross sectional thickness which is greater than the other said vertical sidewalls.

15. The system of claim 12 wherein said annular sighting surface has a diameter of between 1 and 1.6".

16. The method of custom sighting an archer with a bow having a bow string comprising the steps of:

providing a sighting element adjacent a bow in condition to maintain its longitudinal axis coplanar with true vertical when the bow is in shooting condition;

providing an annular sighting reference element having cross hairs disposed with a diameter of said annular reference element;

providing a peep sight on said bow string;

selecting the diameter of one of said peep sight and annular reference element so that when said bow is armed with an arrow and said archer has drawn said arrow and bow string into shooting position, said annular reference element is flush with an interior diametrical opening of said peep sight.

17. The method of claim 16 including selecting the diameter of said annular reference element to be between 1" and 1.6" and the diameter of said peep sight opening to be between 70/1000" and 80/1000".

18. The method of claim 16 including providing said cross hairs are arranged to be vertical and horizontal and at least two horizontal cross hairs denoting at least two sighting ranges.

* * * * *